US006615620B2

(12) United States Patent
Hendrix et al.

(10) Patent No.: US 6,615,620 B2
(45) Date of Patent: Sep. 9, 2003

(54) METHOD FOR INTRODUCING DYES AND OTHER CHEMICALS INTO A TEXTILE TREATMENT SYSTEM

(75) Inventors: Walter A. Hendrix, Raleigh, NC (US); Gerardo A. Montero, Garner, NC (US); C. Brent Smith, Raleigh, NC (US); Donald L. Butcher, Knightdale, NC (US)

(73) Assignee: North Carolina State University, Raleigh, NC (US)

( * ) Notice: Subject to any disclaimer, the term of this patent is extended or adjusted under 35 U.S.C. 154(b) by 0 days.

(21) Appl. No.: 09/888,924

(22) Filed: Jun. 25, 2001

(65) Prior Publication Data

US 2001/0037530 A1 Nov. 8, 2001

Related U.S. Application Data

(62) Division of application No. 09/482,371, filed on Jan. 13, 2000, now Pat. No. 6,261,326.

(51) Int. Cl.[7] ..... D06F 37/00; D06P 5/00

(52) U.S. Cl. ..... 68/207; 68/184; 68/189; 8/475

(58) Field of Search ..... 68/207, 189, 184; 8/475

(56) References Cited

U.S. PATENT DOCUMENTS

| | | | |
|---|---|---|---|
| 3,987,138 | A | 10/1976 | Hege |
| 4,012,194 | A | 3/1977 | Maffei |
| 4,464,172 | A | 8/1984 | Lichtenstein |
| 4,478,720 | A | 10/1984 | Perrut |
| 4,502,488 | A | 3/1985 | Degironimo et al. |
| 4,806,171 | A | 2/1989 | Whitlock et al. |
| 4,923,720 | A | 5/1990 | Lee et al. |
| 4,925,444 | A | 5/1990 | Orkin et al. |
| 4,943,403 | A | 7/1990 | Miyashita et al. |
| 5,027,742 | A | 7/1991 | Lee et al. |

(List continued on next page.)

FOREIGN PATENT DOCUMENTS

| | | |
|---|---|---|
| DE | 39 04 513 A1 | 8/1990 |
| DE | 39 06 724 A1 | 9/1990 |
| DE | 39 06 735 A1 | 9/1990 |
| DE | 43 32 219 A1 | 3/1994 |
| DE | 44 29 470 A1 | 3/1995 |

(List continued on next page.)

OTHER PUBLICATIONS

Saus et al, "The Dyeing of Textiles in Supercritical Carbon Dioxide," Textile Research Journal 63 (3) 135–139.*
Achwal, "Dyeing in Supercritical Carbon Dioxide: Quantum Jump from Ecological Point of View," Colourage, pp. 23–25, (Dec. 1993).

(List continued on next page.)

*Primary Examiner*—Margaret Einsmann
(74) *Attorney, Agent, or Firm*—Jenkins, Wilson & Taylor, P.A.

(57) ABSTRACT

A process for introducing a textile treatment material into a textile treatment system, particularly a supercritical fluid carbon dioxide (SCF—$CO_2$) treatment system. The process includes the steps of providing a preparation vessel in fluid communication with a textile treatment system; loading a textile treatment material into the preparation vessel; dissolving or suspending the textile treatment material in near-critical liquid carbon dioxide or supercritical fluid carbon dioxide in the preparation vessel; and introducing the dissolved or suspended textile treatment material into the textile treatment system. The textile treatment material can be selected from a group including a brightening agent, a whitening agent and a dye. A system suitable for use in carrying out the process is also disclosed.

18 Claims, 6 Drawing Sheets

U.S. PATENT DOCUMENTS

| | | | | |
|---|---|---|---|---|
| 5,105,843 | A | | 4/1992 | Condron et al. |
| 5,169,433 | A | | 12/1992 | Lindsay et al. |
| 5,171,613 | A | | 12/1992 | Bok et al. |
| 5,198,197 | A | | 3/1993 | Clay et al. |
| 5,199,956 | A | | 4/1993 | Schlenker et al. |
| 5,203,843 | A | | 4/1993 | Hoy et al. |
| 5,212,229 | A | | 5/1993 | Taylor et al. |
| 5,233,021 | A | | 8/1993 | Sikorski |
| 5,233,072 | A | | 8/1993 | Kricsfalussy et al. |
| 5,236,602 | A | | 8/1993 | Jackson |
| 5,250,078 | A | | 10/1993 | Saus et al. |
| 5,267,455 | A | | 12/1993 | Dewees et al. |
| 5,268,102 | A | | 12/1993 | Clay et al. |
| 5,269,815 | A | | 12/1993 | Schlenker et al. |
| 5,279,615 | A | | 1/1994 | Mitchell et al. |
| 5,298,032 | A | | 3/1994 | Schlenker et al. |
| 5,306,350 | A | | 4/1994 | Hoy et al. |
| 5,316,591 | A | | 5/1994 | Chao et al. |
| 5,370,742 | A | | 12/1994 | Mitchell et al. |
| 5,374,305 | A | | 12/1994 | Glancy et al. |
| 5,412,958 | A | | 5/1995 | Iliff et al. |
| 5,417,768 | A | | 5/1995 | Smith, Jr. et al. |
| 5,431,843 | A | | 7/1995 | Mitchell et al. |
| 5,443,796 | A | | 8/1995 | Coeling et al. |
| 5,456,759 | A | | 10/1995 | Stanford, Jr. et al. |
| 5,467,492 | A | | 11/1995 | Chao et al. |
| 5,474,812 | A | | 12/1995 | Truckenmuller et al. |
| 5,486,212 | A | | 1/1996 | Mitchell et al. |
| 5,496,901 | A | | 3/1996 | DeSimone |
| 5,509,431 | A | | 4/1996 | Smith, Jr. et al. |
| 5,509,959 | A | | 4/1996 | Nielsen et al. |
| 5,512,058 | A | | 4/1996 | Gavend et al. |
| 5,512,231 | A | | 4/1996 | Thies et al. |
| 5,526,834 | A | * | 6/1996 | Mielnik et al. |
| 5,578,088 | A | | 11/1996 | Schrell et al. |
| 5,601,707 | A | | 2/1997 | Clay et al. |
| 5,613,509 | A | | 3/1997 | Kolb et al. |
| 5,618,894 | A | | 4/1997 | DeSimone et al. |
| 5,651,276 | A | | 7/1997 | Purer et al. |
| 5,669,251 | A | | 9/1997 | Townsend et al. |
| 5,938,794 | A | | 8/1999 | Eggers et al. |
| 5,953,780 | A | * | 9/1999 | Schollmeyer et al. |
| 6,010,542 | A | | 1/2000 | DeYoung et al. |
| 6,048,369 | A | | 4/2000 | Smith et al. |

FOREIGN PATENT DOCUMENTS

| | | | | |
|---|---|---|---|---|
| DE | 43 43 221 | A1 | | 4/1995 |
| DE | 43 36 941 | A1 | | 5/1995 |
| DE | 43 44 021 | A1 | | 6/1995 |
| DE | 44 08 784 | A1 | | 9/1995 |
| EP | 222 207 | B1 | | 5/1991 |
| EP | 474 598 | A1 | | 3/1992 |
| EP | 474 599 | A1 | | 3/1992 |
| EP | 474 600 | A1 | | 3/1992 |
| EP | 514 337 | A1 | | 11/1992 |
| JP | 8-104830 | A | | 4/1996 |
| JP | 8-113652 | A | | 5/1996 |
| SU | 883208 | | | 11/1981 |
| WO | WO 93/14259 | A1 | | 7/1993 |
| WO | WO 94/09201 | A1 | | 4/1994 |
| WO | WO 95/01221 | A1 | | 1/1995 |
| WO | WO 96/00610 | A1 | | 1/1996 |
| WO | WO 97/13915 | | * | 4/1997 |
| WO | WO 97/13915 | A1 | | 4/1997 |
| WO | WO 97/14838 | A1 | | 4/1997 |
| WO | WO 97/14843 | A1 | | 4/1997 |
| WO | WO 97/33033 | A1 | | 9/1997 |
| WO | WO 99/63146 | | | 12/1999 |

OTHER PUBLICATIONS

Atkins, "Physical Chemistry, 5th ed.," W.H. Freeman and Company (New York), pp. 43–44, (1994).

Bartle et al., "Solubilities of Solids and Liquids of Low Volatility in Supercritical Carbon Dioxide," J. Phys. Chem. Ref. Data, vol. 20 (No. 4), p. 713–756, (1991).

Burk et al., "Solubilities of Solids in Supercritical Fluids," The Canadian Journal of Chemical Engineering, vol. 70, p. 403–407, (Apr. 1992).

Dobbs et al., "Modification of Supercritical Fluid Phase Behavior Using Polar Cosolvents," Ind. Eng. Chem. Res., vol. 26 (No. 1), p. 56–65, (1987).

Dobbs et al., "Selectivities in Pure and Mixed Supercritical Fluid Solvents," Ind. Eng. Chem. Res., vol. 26, p. 1476–1482, (1987).

Drews et al., "An Investigation of the Effects of Temperature and Pressure Ramping on Shade in the Stock Dyeing of PET with Supercritical CO2, Part I: Dyeing at Constant T&P," AATCC Book of Papers, p. 360–368, (1996).

Gupta et al., "Solvent Effect on Hydrogen Bonding in Supercritical Fluids," J. Phys. Chem., vol. 97, p. 707–715, (1993).

Haarhaus et al., "High–Pressure Investigations on the Solubility of Dispersion Dyestuffs in Supercritical Gases by VIS/NIR–Spectroscopy. Part I–1, 4–Bis–(octadecylamino)–9,10–anthraquinone and Disperse Orange in CO2 and N2O up to 180 MPa," The Journal Supercritical Fluids, p. 100–106, (1995).

Holme, "Latest Developments in Dyes and Finishes for Man–Made Fibres," International Dryer, p. 13–17, (1993).

Knittel et al., "Application of Supercritical Carbon Dioxide in Finishing Processes," J. Text Inst., vol. 84 (No. 4), p. 534–552, (1993).

Kramrisch, "Dyeing Technical Fibres in Supercritical Carbon Dioxide," International Dyer, p. 12, (Aug. 1992).

Montero et al., "Supercritical Fluid Extraction of Contaminated Soil ," J. Environ. Sci. Health, vol. A32 (No. 2), p. 481–495, (1997).

Phelps et al., "Past, Present, and Possible Future Applications of Supercritical Fluid Extraction Technology," Journal of Chemical Education, vol. 73 (No. 12), p. 1163–1168, (Dec. 1996).

Poulakis et al., "Dyeing of Polyester in Supercritical CO2," Chemiefasern/Textilindustrie, vol. 93 (No. 41), p. 142–147, (Feb. 1991).

Saus et al., "Dyeing with Supercritical Carbon Dioxide–An Alternative to High Temperature Dyeing of Polyester," Textil–praxis International (Foreign Edition), p. 1052–1054, (Nov. 1992).

Saus et al., "Dyeing with Supercritical Carbon Dioxide–physico–Chemical Fundamentals," Textil–praxis International (Foreign Edition), p. 32–36, (Jan. 1993).

Saus et al. , "Dyeing of Textiles in Supercritical Carbon Dioxide," Textile Res. J., vol. 63 (No. 3), p. 135–142, (1993).

Saus et al., "Water–Free Dyeing of Synthetic Material–Dyeing in Supercritical CO2," International Textile Bulletin. Dyeing/Printing/Finishing, p. 20–22, (1993).

Scheibli et al., "Dyeing in Supercritical Carbon Dioxide–An Environmental Quantum Leap in Textile Processing," Chemiefasern/Textilindustrie, vol. 43 (No. 95), p. E64–E65, (1994).

Skoog et al., "Principles of Instrumental Analysis," Saunders College Publishing (Fort Worth), p. 124–126, (1992).

Tavana et al., "Scanning of Cosolvents for Supercritical Fluids Solubilization of Organics," AIChE Journal, vol. 35 (No. 4), p. 645–648, (Apr. 1989).
U.S. Environmental Protection Agency, "Best Management Practices for Pollution Prevention in the Textile Industry," p. 21–22, (Sep. 1996).
Schnitzler et al., "Mass Transfer Phenomena in Polymers During Treatment in a Supercritical CO2–Atmosphere," Proceedings of the Fifth Meeting on Supercritical Fluids, p. 93, (1998).
Sicardi et al., "Hydrodynamics of Supercritical CO2 Flow Through a Spool of Polyester Yarn," Proceedings of Fifth Meeting of Supercritical Fluids, 5th ed., p. 193, (1998).
Bach et al., "Dyeing of Synthetic Fibers in Supercritical Carbon Dioxide," Proceedings of the Fifth Meeting on Supercritical Fluids, p. 345, (1998).
Bork, "Supercritical Fluid Dyeing of Synthetic Fibers," Proceedings of the Fifth Meeting on Supercritical Fluids, p. 387, (1998).
Degiorgi et al., "Dyeing Polyester Fibers with Disperse Dyeing in Supercritical CO2," Proceedings of the Fifth Meeting on Supercritical Fluids, p. 393, (1998).
Shannon, "Development and Evaluation of a Darcy Flow Model for Supercritical Fluid Flow Through Polyester Yarn Packages," M.S. Thesis, College of Textiles, North Carolina State University (Raleigh, North Carolina), (1999).
Swidersky et al., "High–Pressure Investigations on the Solubility of Anthraquinone Dyestuffs in Supercritical Gases by VIS–Spectroscopy. Part II–1, 4–Bis–(n–alkylamino)–9, 10–anthraquinones and Disperse Red II in CO2, N20, CHF3 up to 180 MPa," The Journal of Supercritical Fluids, vol. 9 (No. 1), p. 12–18, (1996).
Shannon et al., "Modeling of Supercritical Fluid Flow Through a Yarn Package," Fifth Conference on Supercritical Fluids and Their Application, p. 419, (Jun. 13, 1999).
Tessari et al., "Impregnation of Polyester Fibers in Supercritical Carbon Dioxide," Fifth conference on Supercritical Fluids and Their Applications, p. 441, (Jun. 13, 1999).
Sicardi et al, "Influence of Disperse Dyes in PET Films During Impregnation With Supercritical CO2," Fifth Conference on Supercritical Fluids and Their Applications, p. 467, (Jun. 13, 1999).
Bach et al., "Treatment of Textile Fibers in Dense Gases–An Overview," Proceedings of the Fifth International Symposium on Supercritical Fluids, (Apr. 8, 2000).
Montero et al., "Supercritical Fluid Technology in Textile Processing," Proceedings of the Fifth International Symposium on Supercritical Fluids, (Apr. 8, 2000).
Sicardi et al., "Dye Diffusion in PET Films in the Presence of a Supercritical or Aqueous Solvent," Proceedings of the Fifth International Symposium on Supercritical Fluids, (Apr. 8, 2000).
Shim et al., "Polymer Sorption of Disperse Dyes in Supercritical Carbon Dioxide," Proceedings of the Fifth International Symposium on Supercritical Fluids, (Apr. 8, 2000).
Bach et al., "Dyeing of Synthetic Fibers in Supercritical Carbon Dioxide, Part 1: Thermo–mechanical Properties of Polyolefin Fibers After Treatment in CO2 Under Dyeing Conditions," J. Text. Inst., vol. 89 (No. 4), p. 647–655, (1998).
Bach et al., "Dyeing of Synthetic Fibers in Supercritical Carbon Dioxide, Part 2: The Influence of Dye Structure on the Dyeing of Fabrics and on Fastness Properties," J. Text. Inst., vol. 89 (No. 4), p. 657–668, (1998).
Bach et al., "Experience with the Uhde CO2–Dyeing Plant on Tehcnical Scale, Part 1: Optimization of the Pilot Plant and First Dyeing Results," Melliand Int., p. 165–168, (1999).
Bach et al., "Correlation of Solubility Data of disperse Dyes with the Dye Uptake of Poly (Ethylene Terephthalate) Fibers (PETP) in Supercritical Carbon Dioxide," Fifth Conference on Supercritical Fluids and Their Applications, p. 427, (Jun. 13, 1999).
Holme, "New Dyes for Supercritical Fluid Dyeing," Int. Dyer, p. 27, 30, (May, 1999).
Chang et al., "Dyeing of PET Fibers and Films in Supercritical Carbon Dioxide," Korean Journal of Chemical Engineering, vol. 13 (No. 3), p. 10–316, (1996).
Bach et al., "Experience With the Uhde CO2–Dyeing Plant on Technical Scale, Part 2: Concepts for the Development of the Pilot Plant in Respect of a Scaling Up of the Machine," Melliand Int., p. 192–194, (1998).
Drews et al., "The Effect of Supercritical CO2 Dyeing Conditions on the Morphology of Polyester Fibers," Text, Chemical and Colorist, vol. 30 (No. 6), p. 13–20, (1998).
Knittel et al., "Dyeing Without Water," Book of Papers, AATCC International Conference & Exhibition, p. 86, (1995).
Bach et al., "Dyeing of Poly (Ethylene Terephthalate) Fibers in Supercritical Carbon Dioxide," Proceedings of the 3rd International Symposium on High–pressure Chemical Engineering, p. 581–586, (1996).
Knittel et al., "Dyeing from Supercritical CO2–Fastness of Dyeing," Melliand English, vol. 75 (No. 5), p. E99, (May, 1994).
Draper et al., "Solubility Relationship for Disperse Dyes in Supercritical Carbon Dioxide," Dyes and Pigments, p. 177–183, (2000).
Wharton, "Ultraviolet Absorbers in Near Critical and Supercritical Carbon Dioxide," M.S. Thesis, College of Textiles, North Carolina State University (Raleigh, North Carolina), (1999).

* cited by examiner

METHOD FOR INTRODUCING DYES AND OTHER CHEMICALS INTO A TEXTILE TREATMENT SYSTEM

This application is a Divisional of co-pending U.S. patent application Ser. No. 09/482,371 filed Jan. 13, 2000 now U.S. Pat. No. 6,261,326, herein incorporated by reference in its entirety.

TECHNICAL FIELD

The present invention relates to generally to textile dyeing and more particularly to the introduction of dyes and other chemicals into a process for dyeing a textile material in a supercritical fluid.

BACKGROUND ART

It will be appreciated by those having ordinary skill in the art that conventional aqueous dyeing processes for textile materials, particularly hydrophobic textile materials, generally provide for effective dyeing, but possess many economic and environmental drawbacks. Particularly, aqueous dyebaths that include organic dyes and co-solvents must be disposed of according to arduous environmental standards. Additionally, heat must be applied to the process to dry the textile material after dyeing in an aqueous bath. Compliance with environmental regulations and process heating requirements thus drive up the costs of aqueous textile dyeing to both industry and the consuming public alike. Accordingly, there is a substantial need in the art for an alternative dyeing process wherein such problems are avoided.

One alternative to aqueous dyeing that has been proposed in the art is the dyeing of textile materials, including hydrophobic textile materials like polyester, in a supercritical fluid. Particularly, textile dyeing methods using supercritical fluid carbon dioxide (SCF—$CO_2$) have been explored.

However, those in the art who have attempted to dye textile materials, including hydrophobic textile materials, in SCF—$CO_2$ have encountered a variety of problems. These problems include, but are not limited to, "crocking" (i.e. tendency of the dye to smudge when the dyed article is touched) of the dye on the dyed textile article; unwanted deposition of the dye onto the article and/or onto the dyeing apparatus during process termination; difficulty in characterizing solubility of the dyes in SCF—$CO_2$; difficulty introducing the dyes into the SCF—$CO_2$ flow; and difficulty in preparing the dyes for introduction into the dyeing process. These problems are exacerbated when attempts to extrapolate from a laboratory process to a plant-suitable process are made.

PCT Publication No. WO 97/13915, published Apr. 17, 1997, designating Eggers et al. as inventors (assigned to Amman and Söhne GmbH and Co.) discloses a system for introducing dye into a $CO_2$ dyeing process which comprises a bypass flow system associated with the main circulation system that includes a color preparing vessel. The bypass is opened, after a certain temperature and pressure are reached, so that SCF—$CO_2$ flows through the color preparing vessel and dissolves the previously loaded dye(s). The SCF—$CO_2$-containing dissolved dye flows from the bypass back into the main circulation system where it joins the bulk of the SCF—$CO_2$ flow that is used to accomplish dyeing.

PCT Publication No. WO 97/14843, published Apr. 24, 1997, designating Eggers et al. as inventors (assigned to Amman and Söhne GmbH and Co.) discloses a method for dyeing a textile substrate in at least one supercritical fluid, wherein the textile substrate is preferably a bobbin and the fluid is preferably SCF—$CO_2$. The disclosed invention attempts to prevent color spots from forming on the textile substrate during dyeing and is directed to ways of incorporating the dye material into the supercritical fluid using the basic bypass system as described above in PCT WO 97/13915.

The method involves the use of at least one dye which is contacted with the supercritical fluid as a dye bed, dye melt, dye solution, and/or dye dispersion before and/or during actual dyeing in an attempt to form a stable solution of dye in the supercritical fluid. A stated goal is avoiding the formation of dye agglomerates having a particle size of more than 30 microns, preferably more than 15 microns, in the solution.

This invention attempts to accomplish these aims through a variety of embodiments. In one embodiment, the dye bed is provided with inert particles, in particularly glass and/or steel balls, to prevent agglomeration. Alternatively, the dye bed itself can consist of inert particles coated with the dye. SCF—$CO_2$ is then passed through the dye bed to incorporate the dye within the SCF—$CO_2$.

However, there are a number of significant drawbacks to this embodiment of the dye introduction method disclosed by Eggers et al. PCT Publication No. WO 97/14843. For example, use of a fixed or fluidized bed to introduce dye into the dyeing system can be hindered if appropriate flow conditions are not present. The dye particles must be at all times in intimate and vigorous contact with the supercritical fluid for effective dissolution. If this is not the case, the dissolution rate will be low and will likely not be complete by the end of the dyeing cycle.

Moreover, promotion of a high convective mass transfer coefficient (i.e., intimate and vigorous mixing) can result in substantial pressure losses through the dye-add vessel. Because of their relatively low viscosity values, supercritical fluids are easily diverted to areas of lower resistance, which can lead to mechanical problems such as channeling and stagnation. Channeling refers to the development of a fluid path, or channel, through a particulate bed that circumvents uniform flow throughout the bed; i.e., a stream of fluid develops through the bed such that the flow in the region where the stream exists is greater than the flow of fluid in the rest of the bed. In this case, the particles not in the channel are not properly contacted by the fluid. These conditions, in turn, result in dye particles not being contacted in a manner that will allow substantially complete dissolution.

Insuring the proper flow conditions when using fluidized dye beds, fixed dye beds, or dye bed holding devices requires very careful and complex design of the internals of the dye-add vessel in order to assure good mixing and to avoid mechanical flow problems without excessive pressure drop. Indeed, it is likely that dye bed holding devices that are chambered to force uniform flow of fluid through the bed, such as those proposed for use in dye introduction by Eggers et al., PCT Publication No. WO 97/14843, also suffer very high pressure losses.

Another drawback arises when the fluidized and fixed dye bed is installed in the system in a bypass loop. Since the dye dissolution process is rate limiting, this arrangement couples the dyeing process to the dye dissolution process, which is generally undesirable. In contrast, the dye should be introduced at a rate consistent with dyeing the textile material as rapidly as possible but also in a level manner.

An alternative embodiment of the dye injection method disclosed by Eggers et al. PCT Publication No. WO 97/14843 involves injection of the dye as a melt incorporated in an inert gas, preferably nitrogen or carbon dioxide (with property of being inert for these two gases being a function of the process conditions). It has been observed by the present applicants that melting of disperse dyes can lead to decreased solubility in SCF—$CO_2$. This circumstance indicates that the applicability of this embodiment of the disclosed dye injection method is limited.

Yet another embodiment of the dye introduction method disclosed by Eggers et al. PCT Publication NO. WO 97/14843 involves delivery of the dye into the supercritical fluid flow as a solution or suspension. When a solution is being injected and water-soluble dyes are being used, the recommended injection solvent is water. For water-insoluble dyes, a variety of common nontoxic injection solvents are suggested, with acetone, which readily dissolves disperse dyes, being foremost. The water-insoluble dyes are injected as a solution or suspension in the chosen solvent. In the case that a suitable nontoxic solvent cannot be found or the required amount of solvent is so great that it adversely affects the dyeing process, injection of a dispersion, preferably an aqueous dispersion, is recommended.

This embodiment of the method disclosed by Eggers et al. PCT Publication No. WO 97/14843 also suffers from several drawbacks. Firstly, water is an anti-solvent in SCF—$CO_2$ when used with disperse dyes. Thus, for SCF—$CO_2$, the presence of water results in a significantly impaired dyeing process to the extent that it is questionable whether dyeing could be accomplished at all. At best, the action of water in the SCF—$CO_2$ would cause the dye to reside in the dyeing process as dispersion. In the worst case, the dye would exist as an unstable suspension with unsuitable properties for dyeing. Secondly, in the case that a suitable SCF—$CO_2$/water/dye dispersion was obtained, the SCF—$CO_2$ dyeing process would be similar to the conventional aqueous process, the replacement of which is a desired goal in the art.

Poulakis et al., *Chemiefasern/Textilindustrie,* Vol. 43–93, February 1991, pages 142–147 discuss the phase dynamics of supercritical carbon dioxide. An experimental section describing an apparatus and method for dyeing polyester in supercritical carbon dioxide in a laboratory setting is also presented. Thus, this reference only generally describes the dyeing of polyester with supercritical carbon dioxide in the laboratory setting and is therefore believed to be limited in practical application.

U.S. Pat. No. 5,199,956 issued to Schlenker et al. on Apr. 6, 1993 describes a process for dyeing hydrophobic textile material with disperse dyes by heating the disperse dyes and textile material in SCF—$CO_2$ with an azo dye having a variety of chemical structures. The patent thus attempts to provide an improved SCF—$CO_2$ dyeing process by providing a variety of dyes for use in such a process.

U.S. Pat. No. 5,250,078 issued to Saus et al. on Oct. 5, 1993 describes a process for dyeing hydrophobic textile material with disperse dyes by heating the disperse dyes and textile material in SCF—$CO_2$ under a pressure of 73 to 400 bar at a temperature in the range from 80° C. to 300° C. Then the pressure and temperature are lowered to below the critical pressure and the critical temperature, wherein the pressure reduction is carried out in a plurality of steps.

U.S. Pat. No. 5,578,088 issued to Schrell et al. on Nov. 26, 1996 describes a process for dyeing cellulose fibers or a mixture of cellulose and polyester fibers, wherein the fiber material is first modified by reacting the fibers with one or more compounds containing amino groups, with a fiber-reactive disperse dyestuff in SCF—$CO_2$ at a temperature of 70–210° C. and a $CO_2$ pressure of 30–400 bar. Specific examples of the compounds containing amino groups are also disclosed. Thus, this patent attempts to provide level and deep dyeings by chemically altering the fibers prior to dyeing in SCF—$CO_2$.

U.S. Pat. No. 5,298,032 issued to Schlenker et al. on Mar. 29, 1994 describes a process for dyeing cellulosic textile material, wherein the textile material is pretreated with an auxiliary that promotes dye uptake subsequent to dyeing, under pressure and at a temperature of at least 90° C. with a disperse dye from SCF—$CO_2$. The auxiliary is described as being preferably polyethylene glycol. Thus, this patent attempts to provide improved SCF—$CO_2$ dyeing by pretreating the material to be dyed.

Despite extensive research into SCF—$CO_2$ textile dyeing processes, there has been no disclosure of a suitable method for introducing dyes or other textile treatment materials into such processes. An environmentally and economically sound method for introducing dyes or other textile treatment materials would be particularly desirable in the plant-scale application of a SCF—$CO_2$ textile dyeing process. Therefore, the development of such a method meets a long-felt and significant need in the art.

DISCLOSURE OF THE INVENTION

A process for introducing a textile treatment material into a textile treatment system is disclosed. The process comprises: (a) providing a preparation vessel in fluid communication with a textile treatment system; (b) loading a textile treatment material into the preparation vessel; (c) dissolving or suspending the textile treatment material in near-critical liquid carbon dioxide or supercritical fluid carbon dioxide in the preparation vessel; and (d) introducing the dissolved or suspended textile treatment material into a textile treatment system. A system suitable for use in carrying out the process is also disclosed.

The process and system of the present invention are preferred for use with a textile treatment system that utilizes SCF—$CO_2$ as a treatment medium. Optionally, the textile treatment material can be selected from a group including, but not limited to, a brightening agent, a whitening agent, a dye and combinations thereof.

Accordingly, it is an object of the present invention to provide an improved process and system for introducing dyes or other textile treatment materials into a textile treatment system, preferably a SCF—$CO_2$ textile treatment system.

It is another object of the present invention to provide an environmentally benign process and system for introducing dyes or other textile treatment materials into a textile treatment system, preferably a SCF—$CO_2$ textile treatment system.

It is another object of the present invention to provide a process and system for introducing dyes or other textile treatment materials into a textile treatment system, preferably a SCF—$CO_2$ textile treatment system, that reduces the loss of such textile treatment materials in a textile processing operation.

It is yet another object of the present invention to provide a process and system for introducing dyes or other textile treatment materials into a textile treatment system, preferably a SCF—$CO_2$ textile treatment system, that can be isolated from the textile treatment system to thereby facilitate addition of dyes and other textile treatment materials thereto.

It is a further object of the present invention to provide an improved process and system for introducing dyes or other textile treatment materials into a textile treatment system, preferably a SCF—$CO_2$ textile treatment system, in accordance with an introduction profile that facilitates correspondence between the introduction rate and an appropriate dyeing rate.

It is a further object of the present invention to provide an improved process and system for introducing dyes or other textile treatment materials into a textile treatment system, preferably a SCF—$CO_2$ textile treatment system, at an introduction point where there is high fluid shear to ensure proper mixing of the introduced treatment material into the textile treatment system.

It is yet a further object of the present invention to provide an improved process and system for introducing dyes or other textile treatment materials into a textile treatment system, preferably a SCF—$CO_2$ textile treatment system, that utilizes supercritical fluid and/or near-critical liquid carbon dioxide as a solvent for the dye or other textile treatment material.

Some of the objects of the invention having been stated herein above, other objects will become evident as the description proceeds, when taken in connection with the accompanying drawings as best described herein below.

DETAILED DESCRIPTION OF THE INVENTION

Figure 1:
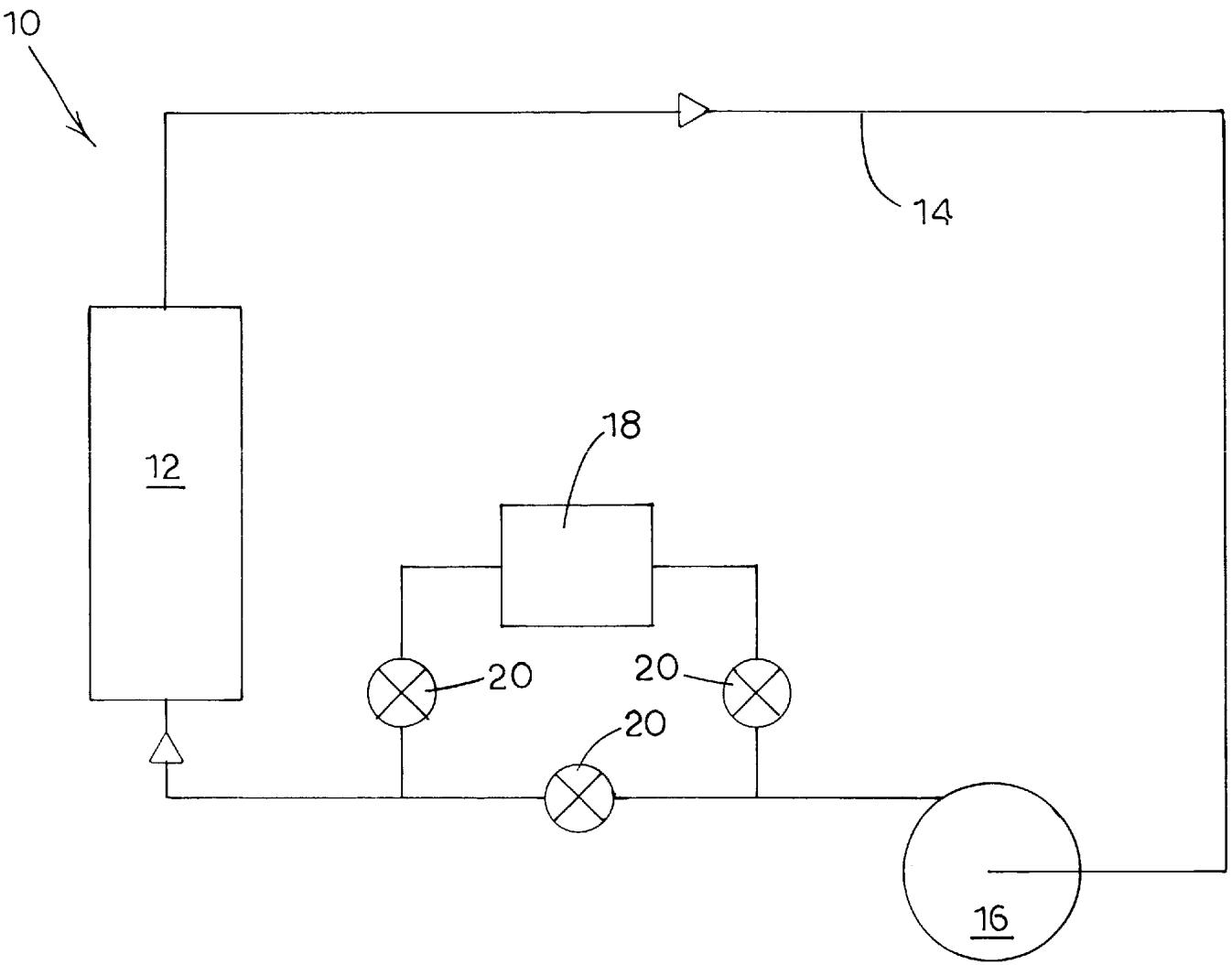
(PRIOR ART) FIG. 1
FIG. 1 is a schematic of a prior art system for introducing textile treatment materials into a SCF—$CO_2$ textile dyeing process.

While the following terms are believed to be well-understood in the art, the following definitions are set forth to facilitate explanation of the invention.

The terms "supercritical fluid carbon dioxide" or "SCF—$CO_2$" are meant to refer to $CO_2$ under conditions of pressure and temperature which are above the critical pressure ($P_c$= about 73 atm) and temperature ($T_c$=about 31° C.). In this state the $CO_2$ has approximately the viscosity of the corresponding gas and a density which is intermediate between the density of the liquid and gas states.

The terms "near-critical liquid carbon dioxide" or "NCL—$CO_2$" are meant to refer to liquid $CO_2$ under conditions of pressure and temperature which are near the critical pressure ($P_c$=about 73 atm) and temperature ($T_c$= about 31° C.).

The term "textile treatment material" means any material that functions to change, modify, brighten, add color, remove color, or otherwise treat a textile material. Examples comprise UV inhibitors, lubricants, whitening agents, brightening agents and dyes. Representative fluorescent whitening agents are described in U.S. Pat. No. 5,269,815, herein incorporated by reference in its entirety. The treatment material is, of course, not restricted to those listed herein; rather, any textile treatment material compatible with the introduction and treatment systems is envisioned in accordance with the present invention.

The term "dye" is meant to refer to any material that imparts a color to a textile material. Preferred dyes comprise sparingly water-soluble or substantially water-insoluble dyes. More preferred examples include, but are not limited to, forms of matter identified in the *Colour Index,* an art-recognized reference manual, as disperse dyes. Preferably, the dyes comprise press-cake solid particles which has no additives.

The term "disperse dye" is meant to refer to sparingly water soluble or substantially water insoluble dyes.

The term "sparingly soluble", when used in referring to a dye, means that the dye is not readily dissolved in a particular solvent at the temperature and pressure of the solvent. Thus, the dye tends to fail to dissolve in the solvent, or alternatively, to precipitate from the solvent, when the dye is "sparingly soluble" in the solvent at a particular temperature and pressure.

The term "hydrophobic textile fiber" is meant to refer to any textile fiber comprising a hydrophobic material. More particularly, it is meant to refer to hydrophobic polymers which are suitable for use in textile materials such as yarns, fibers, fabrics, or other textile material as would be appreciated by one having ordinary skill in the art. Preferred examples of hydrophobic polymers include linear aromatic polyesters made from terephathalic acid and glycols; from polycarbonates; and/or from fibers based on polyvinyl chloride, polypropylene or polyamide. A most preferred example comprises one hundred fifty denier/34 filament type 56 trilobal texturized yarn (polyester fibers) such as that sold under the registered trademark DACRON® (E.I. Du Pont De Nemours and Co.). Glass transition temperatures of preferred hydrophobic polymers, such as the listed polyesters, typically fall over a range of about 55° C. to about 65° C. in SCF—$CO_2$.

The term "crocking", when used to describe a dyed article, means that the dye exhibits a transfer from dyed material to other surfaces when rubbed or contacted by the other surfaces.

Following long-standing patent law convention, the terms "a" and "an" mean "one or more" when used in this application, including the claims.

A critical step in the treating of textile materials in a supercritical fluid (e.g., SCF—$CO_2$) involves the introduction of textile treatment material (e.g., dyes and other chemicals). Current introduction methods employed in SCF—$CO_2$ textile dyeing systems are somewhat similar to those used in commercial aqueous dyeing systems.

An exemplary prior art system is shown schematically in FIG. 1 and generally designated 10. As shown in FIG. 1, dyeing system 10 comprises a dyeing vessel 12, a dyeing circulation loop 14, a dyeing loop circulation pump 16, a dye-add vessel 18, and a series of SCF—$CO_2$ flow control valves 20. Dye is introduced into system 10 by placing it in dye-add vessel 18, which can accommodate flow of SCF—$CO_2$. SCF—$CO_2$ flow is mediated by circulation pump 16. At the appropriate time in the dyeing process, a portion of the main SCF—$CO_2$ flow (represented by arrows in FIG. 1) is diverted from dye circulation loop 14 via valves 20 into dye-add vessel 18 in order to effect dissolution of the dye. The diverted SCF—$CO_2$ flow, laden with dissolved dye, then re-enters and mixes with the main SCF—$CO_2$ flow in loop 14 for use in dyeing the textile material, which is placed in vessel 12.

In marked contrast to prior art methods and systems, the textile treatment material introduction process and system of the present invention decouple the textile treatment material dissolution process from the treatment process. The dye introduction rate is used to effect control over the dyeing rate in order to minimize non-uniform dyeing behavior, such as shading and streaking. As such, the dye introduction rate is varied to achieve amounts of dye in solution ranging from near zero up to the equilibrium value at each set of dyeing conditions ($CO_2$ density and temperature). Though a variety of solvents or carrier fluids can be used in the method and system of the present invention, the preferred preparation fluid is pure $CO_2$ in supercritical or near-critical liquid form.

The dye is introduced as a solution or suspension (dispersion) in SCF—$CO_2$ or NCL—$CO_2$, depending on the required dye injection rate and the degree of solvency of SCF—$CO_2$ in the textile treatment system at the existing treatment conditions. As such, the use of surfactants or dispersing chemicals is not required in the introduction process and system of the present invention. However, co-solvents or surfactants may optionally be used to enhance dye solubility and dispersing agents may optionally be used to facilitate the establishment of stable suspensions of textile treatment materials in $CO_2$.

Preferably, the textile treatment material introduction process and system of the present invention is used in conjunction with a method for treating a textile material using supercritical fluid carbon dioxide (SCF—$CO_2$). More preferably, the textile treatment material introduction method and system of the present invention are used in the treatment of a hydrophobic textile material, such as polyester, in SCF—$CO_2$. However, application of the process and system of the present invention to other textile treatment processes and systems is contemplated.

For example, the method and system of the present invention also can be used with conventional aqueous dyeing processes. This is particularly the case with respect to treatment materials that are sparingly soluble in water. The textile treatment material introduction method and system of the present invention are used to predissolve such treatment materials, and the treatment materials are then introduced into a conventional aqueous dyebath. The use of environmentally hazardous organic co-solvents is thus avoided.

The textile treatment material introduction process and system of the present invention facilitate introduction of a textile treatment material, such as a dye, into a textile treatment process in that the treatment material is already dissolved or suspended when it contacts the solvent used in the treatment process. Thus, problems, such as agglomeration of particles, that have been observed in prior art processes, including particularly prior art SCF—$CO_2$ dyeing processes, are avoided.

Figure 2:
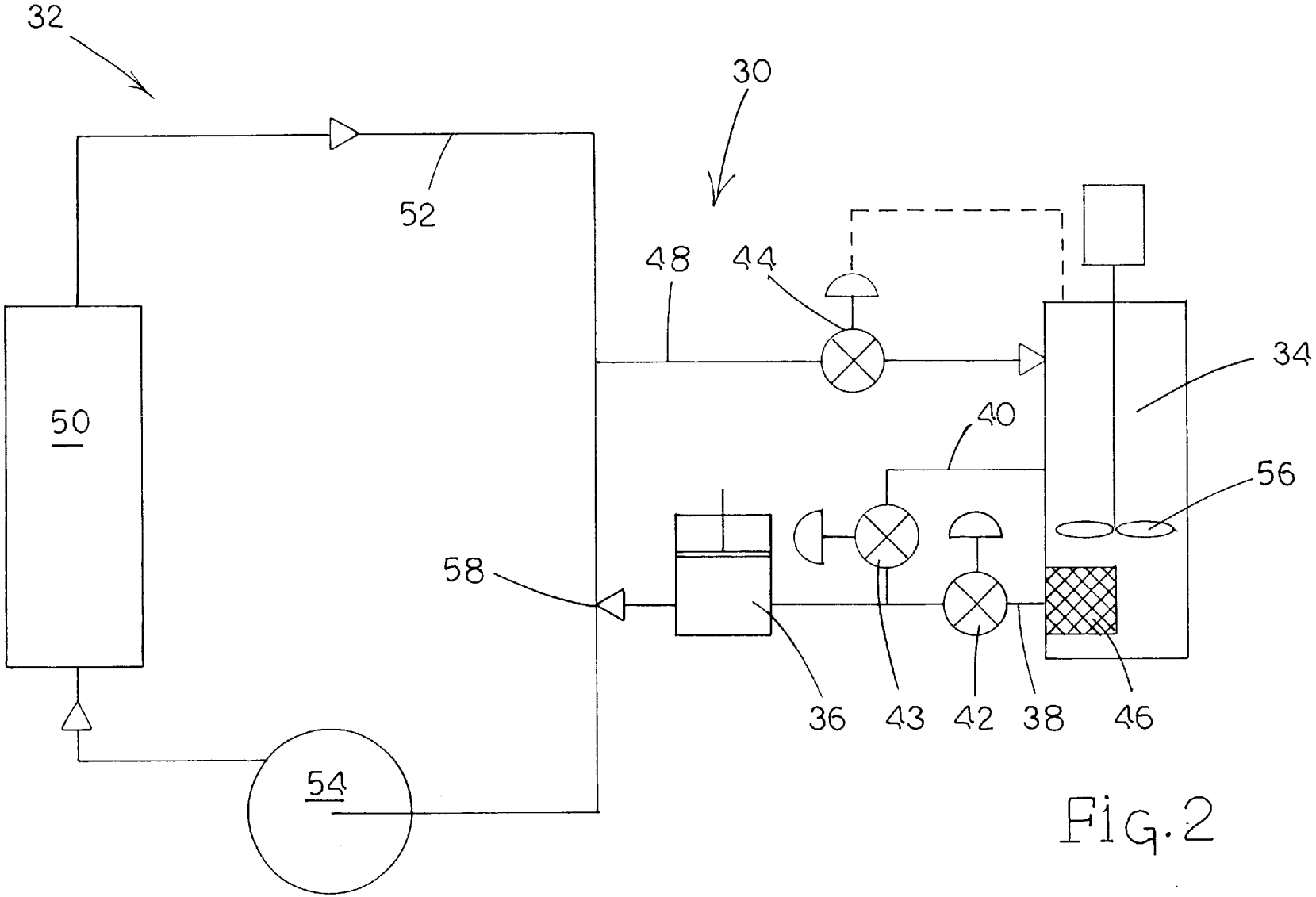
FIG. 2 is a schematic of a system for introducing textile treatment materials into a textile treatment system wherein the system utilizes a stirred dye-add vessel in accordance with a process of the present invention.

Referring now again to the drawings, a preferred embodiment of the textile treatment material introduction system of the present invention is generally designated 30 in FIG. 2. Referring to FIG. 2, system 30 introduces textile treatment materials dissolved or suspended in NCL—$CO_2$ or SCF—$CO_2$ into a textile treatment system 32 (similar to the prior art system shown in FIG. 1), which preferably comprises a SCF—$CO_2$ textile treatment system. System 30 comprises dye-add or preparation vessel 34, positive-displacement metering pump 36, line sections 38 and 40, control valves 42, 43 and 44, filter 46 and return line 48. Treatment system 32 comprises a treatment vessel 50, a circulation loop 52 and a circulation pump 54.

Continuing with reference to FIG. 2, a textile treatment material is placed in preparation vessel 34, which is equipped with a stirring device 56 capable of thoroughly mixing the contents of vessel 34. Stirring device 56 comprises a motor-driven fan, but may also comprise a motor-driven shaft, a rotatably mounted shaft, or any other suitable stirring device as would be apparent to one of ordinary skill in the art after reviewing the disclosure of the present invention. Other stirring devices include a fan, propeller or paddle that is magnetically coupled to a motor rather than coupled to the motor by a solid shaft. Another approach, though mechanically more difficult, comprises placing the dye bed within a holding container within the preparation vessel that is both permeable to flow of the SCF—$CO_2$ and capable of being agitated within the fluid. The permeable holding container can thus be adapted for rotation via the flow of SCF—$CO_2$ to provide mixing of the dye bed with the SCF—$CO_2$. Such devices, and equivalents thereof, thus comprise "stirring means" and "mixing means" as used herein and in the claims.

Continuing with reference to FIG. 2, in operation the preparation vessel 34 of system 30 is sealed and charged with NCL—$CO_2$ or SCF—$CO_2$. The amount of $CO_2$ initially charged and the state of $CO_2$ (i.e., NCL—$CO_2$ or SCF—$CO_2$) depends on the $CO_2$ density desired at the introduction conditions. If a co-solvent, surfactant or dispersing agent is to be used, it is charged along with the textile treatment material, or introduced with a metering pump (not shown in FIG. 2) into the preparation vessel 34 at some point in the textile treatment material preparation process. The contents of the preparation vessel 34 are then heated with mixing to the introduction conditions (i.e., $CO_2$ density and temperature), which is contemplated to be a pressure that is near the textile treatment system pressure.

Preferably, introduction system 30, and particularly preparation vessel 34, is isolated from treatment system 32 when the solution or suspension of textile treatment material is prepared. Control valves 42, 43 and 44 are used to isolate preparation vessel 34 and thus can be opened and closed for reversibly isolating preparation vessel 34. Any other suitable structure, such as other valves, piping or couplings, as would be apparent to one of ordinary skill in the art after reviewing the disclosure of the present invention may also be used to isolate, preferably to reversibly isolate, preparation vessel 34. Such devices and structures, and equivalents thereof, thus comprise "isolation means" as used herein and in the claims.

Continuing with FIG. 2, depending on the introduction conditions and amount of textile treatment material present, the textile treatment material resides in a suspension or in a combination of solution and suspension. If introducing of a textile treatment material solution is desired, the fluid is removed from preparation vessel 34 via line section 38, which is equipped with a filter 46, and via control valve 42. The filtering media of filter 46 has pore sizes predetermined from the particle size distribution and solubility characteristics of the textile treatment material. If introducing of a textile treatment material suspension or combination of textile treatment material solution and suspension is desired, the fluid is removed from the preparation vessel 34 via line section 40 and control valve 43.

Continuing with reference to FIG. 2, positive-displacement metering pump 36 introduces the textile treatment material-laden NCL—$CO_2$ or SCF—$CO_2$ into the circulation loop 52 of treatment system 32 using a introducing rate profile that is consistent with producing uniformly-treated textile materials in minimum processing time. In a preferred embodiment, pump 36 shown in FIG. 2 comprises a positive displacement pump with a reciprocating piston. Other representative pumps include a syringe type pump employing a mechanical piston (FIGS. 4–6) as described below and a syringe type pump employing an inert fluid as a piston (FIGS. 7 and 8) as described below. Thus, devices such as pumps, nozzles, injectors, combinations thereof, and other devices as would be apparent to one of ordinary skill in the art after reviewing the disclosure of the present invention, and equivalents thereof, comprise "introducing means" as used herein and in the claims.

Mixing of the preparation vessel 34 is continued throughout the introduction cycle via mechanical stirring with stirring device 56. Introducing of the textile treatment material-laden NCL—$CO_2$ or SCF—$CO_2$ occurs at an introduction point 58 in the circulation loop 52 where fluid shear is very high. For example, point 58 may lie before or after circulation pump 54 or in a mixing zone that contains static mixing elements (not shown in FIG. 2) in order to facilitate mixing with the treatment medium (e.g. SCF—$CO_2$) flowing in circulation loop 52 of treatment system 32. The term "high fluid shear" refers to a turbulent flow or a flow with high rate of momentum transfer. Preferably, the term "high fluid shear" refers to a flow having a Reynolds number greater than 2300, and more preferably, greater than 5000.

When the textile treatment material is introduced as a solution from preparation vessel 34 into a SCF—$CO_2$ treatment system 32, $CO_2$ makeup to introduction system 30 occurs via return line 48. This action is taken in order to maintain the $CO_2$ density in introduction system 30. Makeup of $CO_2$ involves opening the control valve 44 in the return line 48 such that SCF—$CO_2$ is diverted from circulation loop 52 to preparation vessel 34 in quantities sufficient to maintain the operating pressure of the introduction system 30. Thus, control valve 44 and return line 48, or any other suitable structure, such as other valves or couplings, as would be apparent to one of ordinary skill in the art after reviewing the disclosure of the present invention may be used to divert SCF—$CO_2$ to preparation vessel 34. Such devices and structures, and equivalents thereof, thus comprise "diverting means" as used herein and in the claims.

When textile treatment material is dosed as a suspension into the treatment system 32, introduction system 30 operates with full or partial $CO_2$ makeup via return line 48. When textile treatment material introducing is performed without $CO_2$ makeup, the control valve 44 in return line 48 remains closed throughout the introduction cycle, and preparation vessel 34 is emptied of its contents during the introduction cycle. For introduction of suspension with full makeup, control valve 44 operates as described above. In the case of partial makeup, control valve 44 is operated intermittently to return SCF—$CO_2$ from circulation loop 52 to preparation vessel 34; i.e., preparation vessel 34 is partially emptied and then refilled with return SCF—$CO_2$.

In the case of full or partial makeup to introduction system 30 when NCL—$CO_2$ is utilized in system 30, the pressure of the returning SCF—$CO_2$ stream is reduced substantially across control valve 44 and return line 48 to match the near-critical liquid pressure in preparation vessel 34.

Figure 3:
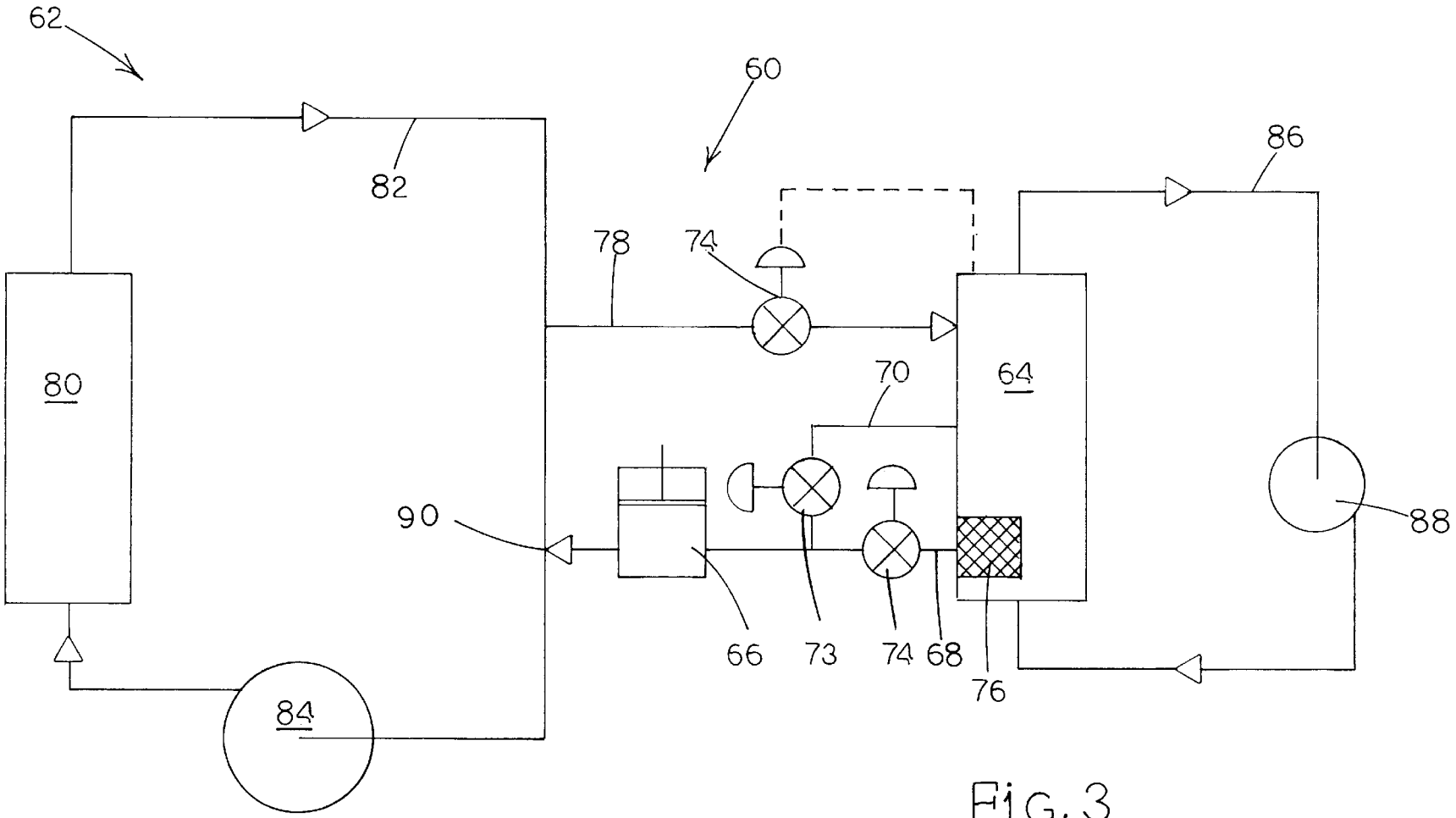
FIG. 3 is a schematic of a system for introducing textile treatment materials into a textile treatment system wherein the system utilizes a circulated dye-add loop in accordance with a process of the present invention.

Referring now to FIG. 3, an alternative embodiment of the textile treatment material introduction system 30 shown in FIG. 2 is disclosed and generally designated 60. In alternative embodiment 60, treatment materials are introduced in NCL—$CO_2$ or SCF—$CO_2$ into textile treatment system 62, which preferably comprises a SCF—$CO_2$ textile treatment process. System 60 comprises dye-add or preparation vessel 64, positive-displacement metering pump 66, line sections 68 and 70, control valves 72, 73 and 74, filter 76 and return line 78. Treatment system 62 comprises a treatment vessel 80, a circulation loop 82 and a circulation pump 84.

Textile treatment material is placed in the preparation vessel 64 of system 60. Preparation vessel 64 is equipped with a mixing loop 86 as shown in FIG. 3. Thus, mixing of the preparation vessel 64 is continued throughout the introducing cycle via fluid circulation (demonstrated by arrows in FIG. 3) by circulation pump 88 through mixing loop 86. Such devices and structures, and equivalents thereof, thus comprise "circulation means" and "mixing means" as used herein and in the claims. Other aspects of alternative embodiment 60 function as described above, including the introduction of treatment material at high fluid shear introduction point 90.

Referring again to FIGS. 2 and 3, the method and system of the present invention also contemplate treating a textile material after introduction of a textile treatment material from the introduction system to the treatment system. The treatment system comprises a treatment vessel, a circulation loop, and a circulation pump. In a preferred embodiment, the treatment system comprises a SCF—$CO_2$ treatment system. A textile material, such as a hydrophobic textile fiber, is placed in the treatment vessel. A solution or suspension of treatment material is introduced into the treatment system at an introduction point from the introduction system as described above. The flow, represented by arrows in FIGS. 2 and 3, of the medium used in the treatment system (e.g. SCF—$CO_2$ flow) is mediated by the circulation pump. The circulation pump directs the flow of treatment medium, which now includes the solution or suspension of treatment material, along the circulation loop to the treatment vessel. In accordance with a preferred embodiment of the present invention, if a suspension is introduced into the treatment circulation loop, the conditions in the loop are such that the suspended material is rapidly dissolved in the treatment flow of supercritical fluid and not carried further as a suspension. Thus, the introduction is preferably made into an area of high shear to promote rapid mixing and dissolution of any undissolved treatment material particles. Within the vessel the treatment material contacts the textile material for a suitable time to impart the desired characteristics to the textile material.

Figure 4:
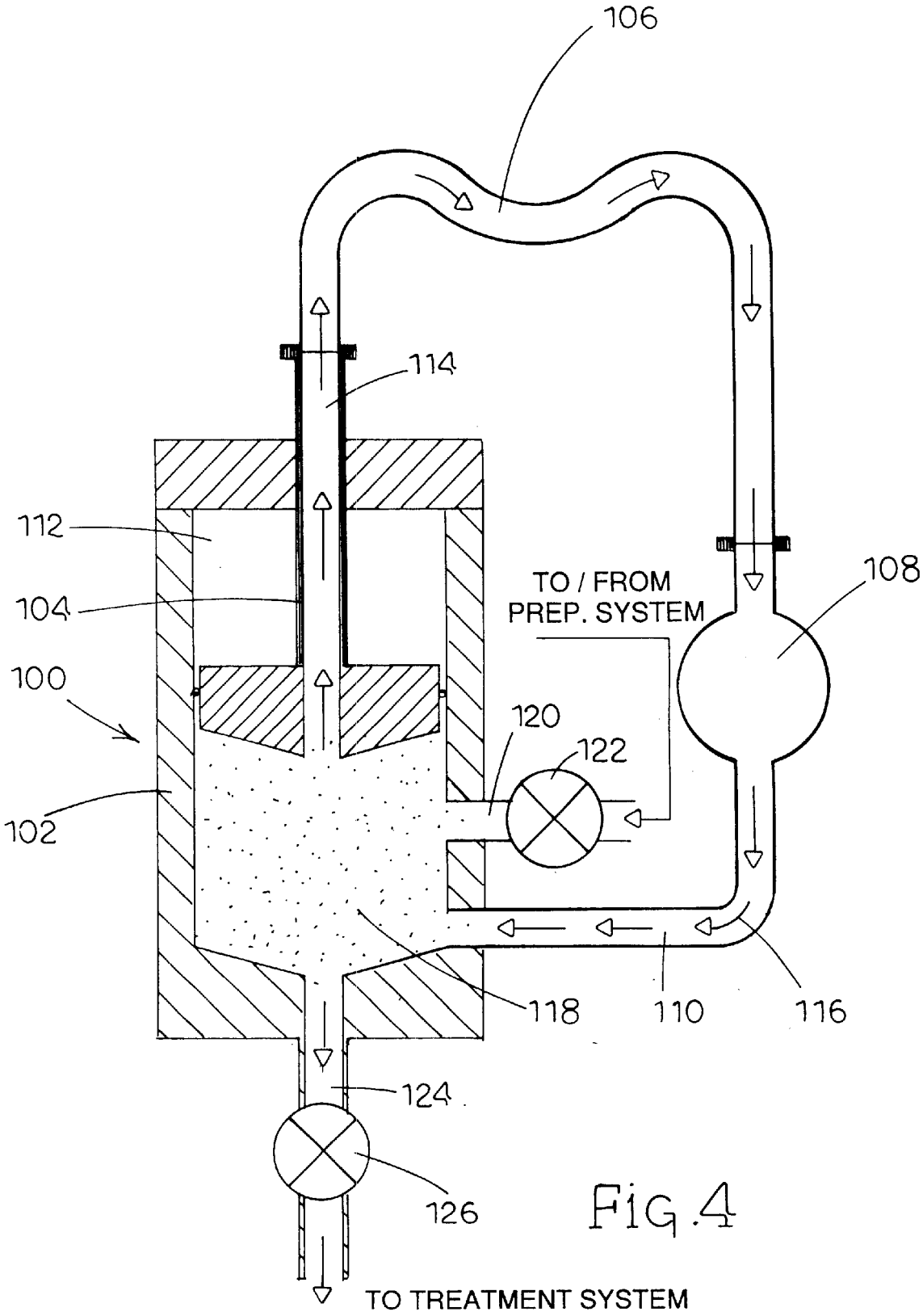
FIG. 4 is a schematic of a syringe pump with mechanical piston and circulation pump for use in a system for introducing textile treatment materials into a textile treatment system in accordance with the present invention.

Referring now to FIG. 4, an embodiment of a syringe pump suitable for use as an introducing means in accordance with the present invention is disclosed and is generally designated 100. Syringe pump 100 comprises syringe pump body 102, piston 104, high pressure hose section 106, circulation pump 108, and high pressure hose section 110. Syringe pump body 102 comprises an internal void space 112 in which piston 104 is slidably mounted. Piston 104 comprises an axial channel 114 through which the flow 116 (represented by arrows in FIG. 4) of SCF $CO_2$ travels within syringe pump 100.

Figure 8:
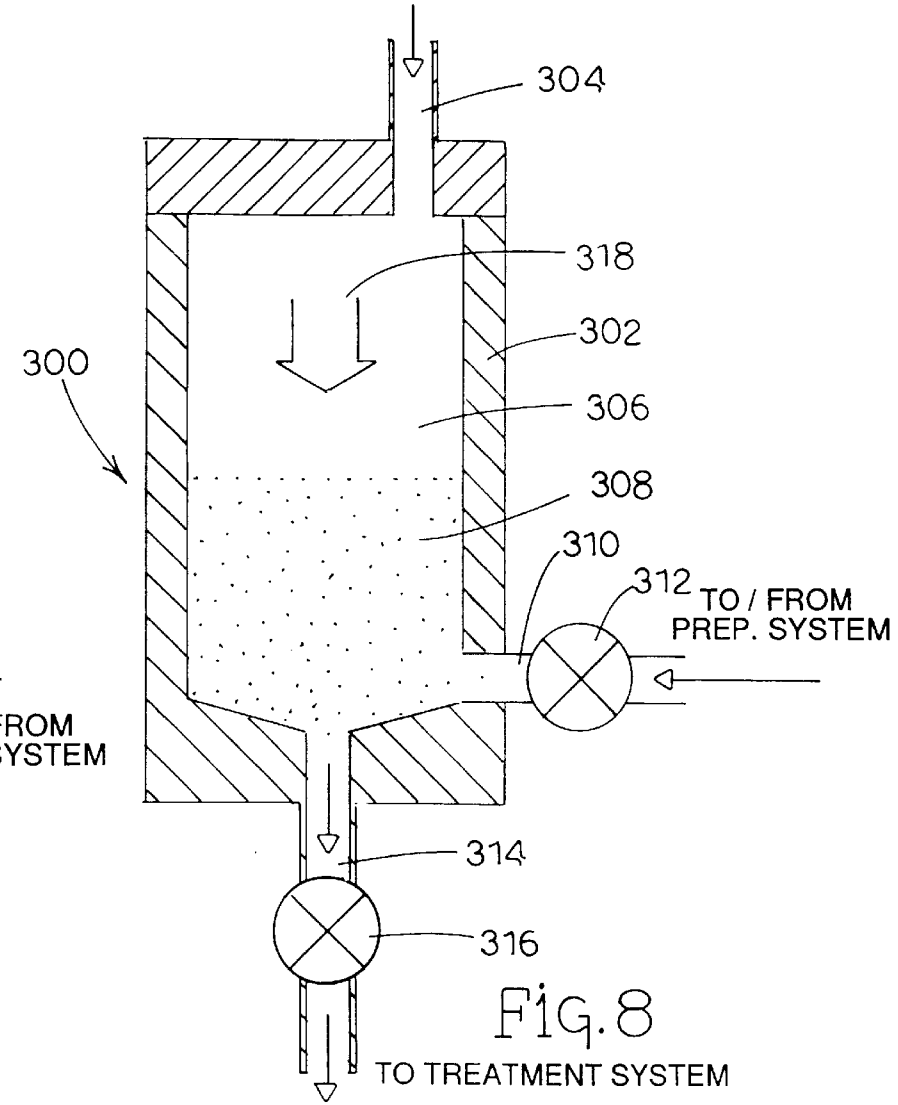
FIG. 8 is a schematic of a syringe pump with an inert fluid piston and no agitation for use in a system for introducing textile treatment materials into a textile treatment system in accordance with the present invention.
Figure 7:
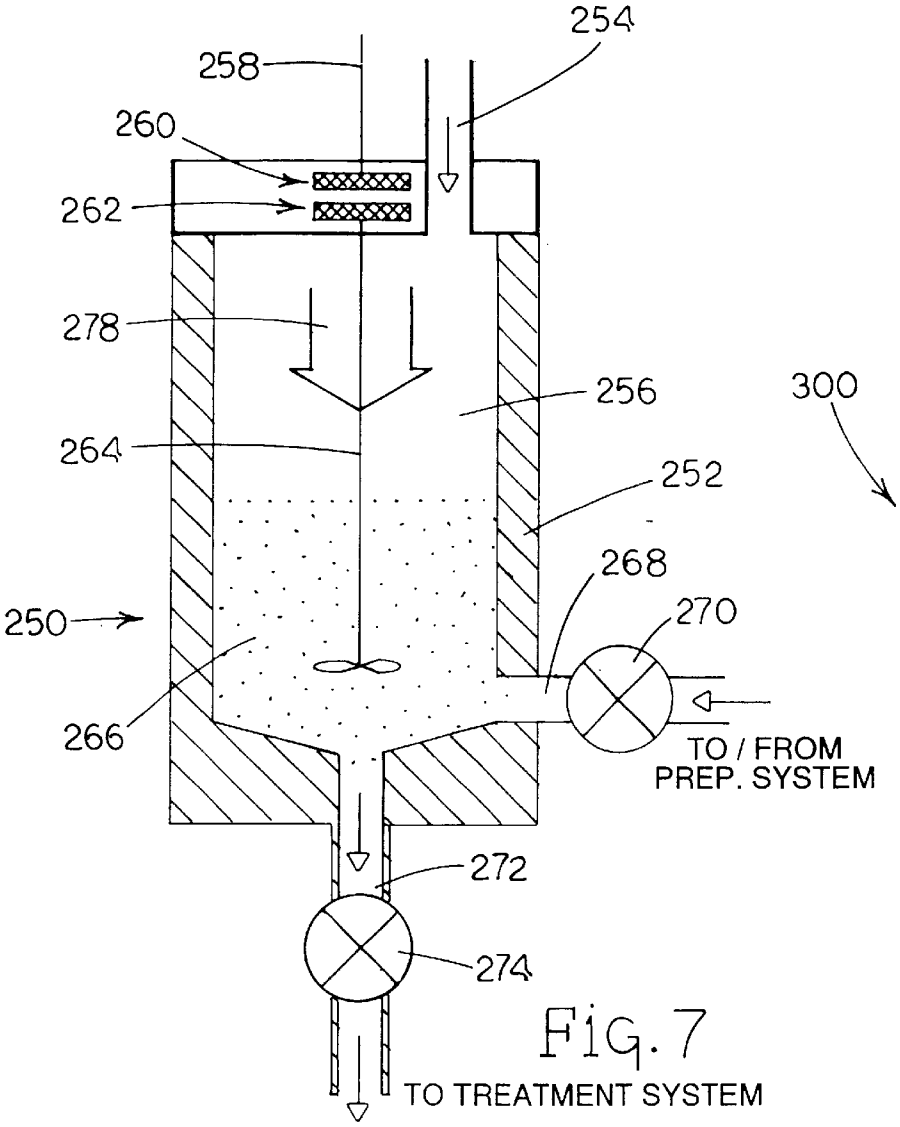
FIG. 7 is a schematic of a syringe pump with an inert fluid piston and magnetically coupled stirrer for use in a system for introducing textile treatment materials into a textile treatment system in accordance with the present invention.

Continuing with FIG. 4, circulation pump 108 is connected to syringe pump body 102 via high pressure hose sections 106 and 110. Circulation within syringe pump 100 is thus provided via circulation pump 108. Treatment material-laden SCF $CO_2$ 118 enters syringe pump 100 from a preparation system via line 120 and valve 122. Circulation, or other type of agitation, is preferred if further dissolution of the dye is being accomplished or if an unstable suspension of the dye is being introduced. If circulation or agitation is not required (e.g., when introducing a stable suspension of the dye), an inert gas piston might be substituted for the mechanical piston, as discussed below and as shown in FIGS. 7 and 8. Syringe pump 100 then propels treatment material-laden SCF $CO_2$ 118 into a treatment system via line 124 and valve 126.

Figures 5, 6:
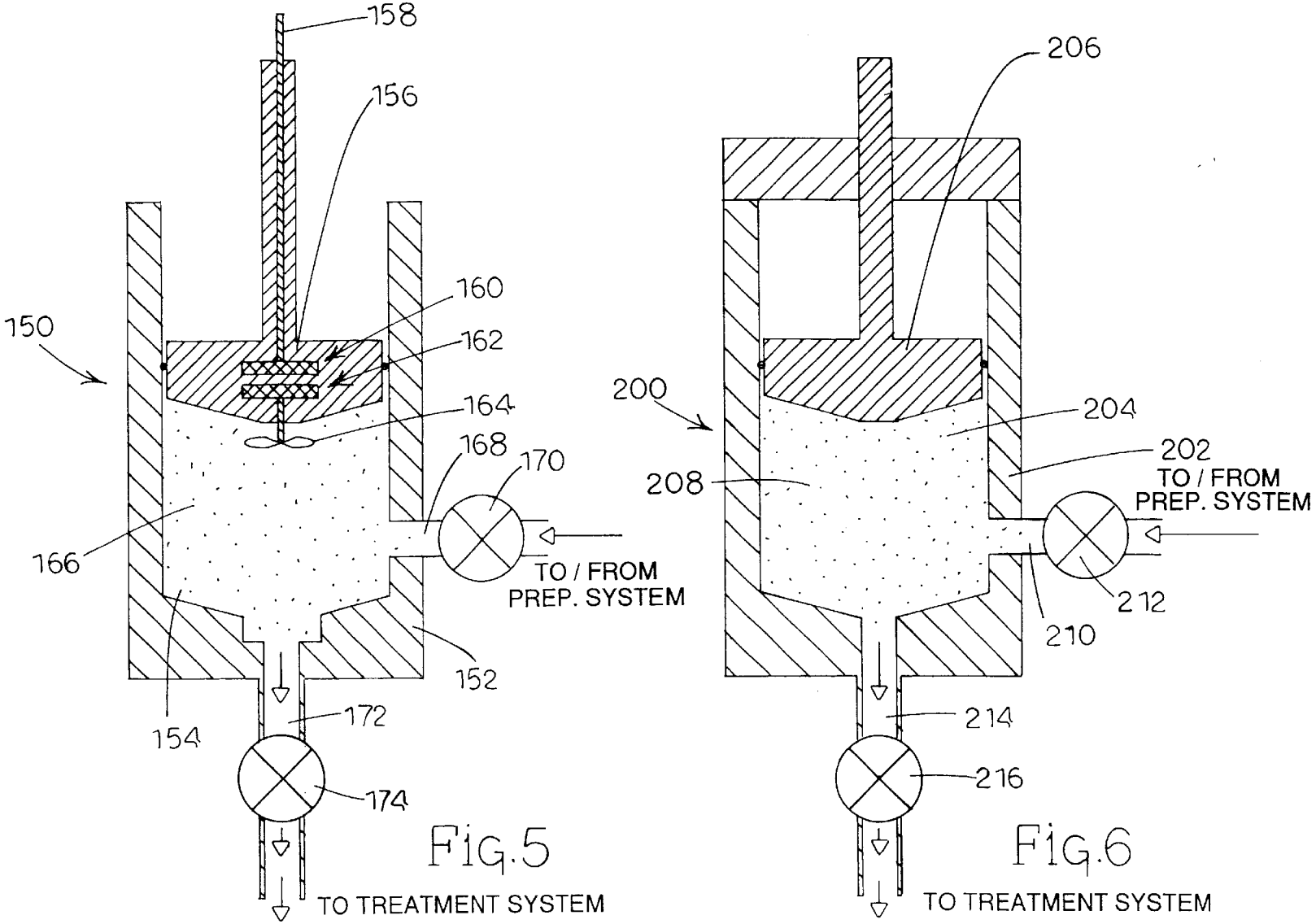
FIG. 5 is a schematic of a syringe pump with mechanical piston and magnetically coupled stirrer for use in a system for introducing textile treatment materials into a textile treatment system in accordance with the present invention.
FIG. 6 is a schematic of a syringe pump with mechanical piston and no agitation for use in a system for introducing textile treatment materials into a textile treatment system in accordance with the present invention.

Referring now to FIG. 5, an alternative embodiment of a syringe pump suitable for use as an introducing means in accordance with the present invention is disclosed and is generally designated 150. Syringe pump 150 comprises a syringe pump body 152 having an internal void space 154 wherein a syringe pump piston 156 is slidably mounted. Syringe pump piston 156 comprises an axially mounted stirrer shaft 158 having a stirrer shaft magnet 160 mounted at the end of stirrer shaft 158 proximate to stirrer magnet 162. Stirrer magnet 162 is also mounted within syringe pump piston 156, and propeller stirrer 164 extends from stirrer magnet 162 into the internal void space 154 of syringe pump 150.

Continuing with FIG. 5, treatment material-laden SCF $CO_2$ 166 enters syringe pump 150 from a preparation system via line 168 and valve 170. Agitation of treatment material-laden SCF $CO_2$ 166 is accomplished within syringe pump 150 via propeller stirrer 164. Syringe pump 150 then propels treatment material-laden SCF $CO_2$ 166 into a treatment system via line 172 and valve 174.

Referring now to FIG. 6, yet another alternative embodiment of a syringe pump suitable for use as an introducing means in accordance with the present invention is disclosed and is generally designated 200. Syringe pump 200 comprises a syringe pump body 202 having an internal void space 204, and a piston 206 slidably mounted within the interval void space 204 of syringe pump body 202. Treatment material-laden dye 208 enters syringe pump 200 from a preparation system via line 210 and valve 212. Syringe pump 200 then propels treatment material-laden SCF $CO_2$ 208 into a treatment system via line 214 and valve 216.

Referring now to FIG. 7, another alternative embodiment of a syringe pump suitable for use as an introducing means in accordance with the present invention is disclosed and is generally designated 250. Syringe pump 250 comprises pump body 252 having an internal void space 256, and a high pressure fluid inlet line 254. A stirrer shaft 258 and a stirrer shaft magnet 260 are mounted at the end of the syringe pump body 252 opposite the line 272 and valve 274 that connect pump 250 with a treatment system. A stirrer magnet 262 is also mounted in pump body 252 proximate to stirrer shaft magnet 260. A propeller stirrer 264 extends into the internal void space 256 of pump body 252 from stirrer magnet 262.

Continuing with FIG. 7, treatment material-laden SCF $C_2$ 266 enters pump 250 from a preparation system via line 268 and valve 270. An inert material 278 (designated with a large arrow in FIG. 7), such as supercritical fluid nitrogen, is introduced into the internal void space 256 of pump body 252 via inlet line 254 while propeller stirrer 264 stirs the treatment material-laden SCF $CO_2$ 266. The in-flow inert material 278 drives treatment material-laden SCF $CO_2$ 266 into a treatment system via line 272 and valve 274.

Referring finally to FIG. 8, still another alternative embodiment of a syringe pump suitable for use as an introducing means in accordance with the present invention is disclosed and is generally designated 300. Syringe pump 300 comprises pump body 302 having an internal void space 306, and a high pressure inlet line 304 connected at the end of pump body 302 opposite from the line 314 and valve 316 that connect syringe pump 300 with a treatment system.

Continuing with FIG. 8, treatment material-laden SCF $CO_2$ 308 enters syringe pump 300 from a preparation system via line 310 and valve 312. An inert material 318 (designated with a large arrow in FIG. 8), such as supercritical fluid nitrogen, is introduced into the internal void space 306 of pump body 302 via high pressure line 304. Inert material 318 thus drives treatment material-laden SCF $CO_2$ 308 into a treatment system via line 314 and valve 316.

The syringe pumps disclosed in FIGS. 4–8 can also be used in maintaining the SCF—$CO_2$ density in the preparation vessel by facilitating the addition of fresh SCF—$CO_2$ to the preparation vessel at the conditions in the preparation vessel without necessarily diverting SCF—$CO_2$ from the treatment system. For example, additional SCF—$CO_2$ can be introduced via high pressure lines 106 and/or 110 in FIG. 4. This approach also adds additional SCF—$CO_2$ to the treatment system, and the treatment process is altered to include a different treatment process control strategy to accommodate the additional SCF—$CO_2$. Thus, the pumps disclosed in FIGS. 4–8 also provide an alternative embodiment of the present invention in which SCF—$CO_2$ density is maintained in the preparation system without diverting SCF—$CO_2$ to the preparation vessel from the treatment system.

An advantage of the textile treatment material introduction process and system of the present invention is that it is used to introduce a variety of chemicals for treatment of a textile material. Thus, multiple operations can be performed concurrently or sequentially. For example, once a first textile treatment material, such as a dye, is introduced, the introducing system can be isolated and depressurized. Then, another textile treatment material, such as a UV inhibitor, can placed in the preparation vessel for introduction into the treatment system in accordance with the steps described herein above.

It will be understood that various details of the invention may be changed without departing from the scope of the invention. Furthermore, the foregoing description is for the purpose of illustration only, and not for the purpose of limitation—the invention being defined by the claims.

What is claimed is:

1. A system for introducing a textile treatment material and for treating a textile material, the system comprising:

(a) a preparation vessel adapted for placement in fluid communication with a textile treatment system, the preparation vessel also adapted for receiving a textile treatment material and for containing near-critical liquid carbon dioxide or supercritical fluid carbon dioxide at a first set of temperature, pressure and flow conditions;

(b) introducing means for introducing a solution or suspension of textile treatment material into a textile treatment system; and (c) a textile treatment system that is adapted to be maintained at a second set of temperature, pressure and flow conditions controllably independent from the first set of temperature, pressure and flow conditions.

2. The system of claim 1, further comprising isolating means for reversibly isolating the preparation vessel from the textile treatment system.

3. The system of claim 1, further comprising mixing means for mixing a textile treatment material with near-critical liquid carbon dioxide or supercritical fluid carbon dioxide in the preparation vessel.

4. The system of claim 3, wherein the mixing means comprises circulating means for circulating a textile treatment material and near-critical liquid carbon dioxide or supercritical fluid carbon dioxide through the preparation vessel.

5. The system of claim 3, wherein the mixing means comprises stirring means for stirring a textile treatment material and near-critical liquid carbon dioxide or supercritical fluid carbon dioxide in the preparation vessel.

6. The system of claim 1, further comprising a filter for filtering a solution of textile treatment material prior to introducing the solution into the textile treatment system.

7. The system of claim 1, wherein the textile treatment system is a supercritical fluid textile treatment system.

8. The system of claim 7, wherein the supercritical fluid textile treatment system is a supercritical fluid carbon dioxide textile treatment system.

9. The system of claim 8, further comprising diverting means for diverting carbon dioxide from the supercritical fluid carbon dioxide textile treatment system to the preparation vessel.

10. A system for introducing a textile treatment material and for treating textile materials, the system comprising:

(a) a preparation vessel adapted for placement in fluid communication with a textile treatment system, the preparation vessel also adapted for receiving a textile treatment material and for containing near-critical liquid carbon dioxide or supercritical fluid carbon dioxide at a first set of temperature, pressure and flow conditions;

(b) isolating means for reversibly isolating the preparation vessel from a textile treatment system;

(c) mixing means for mixing a textile treatment material with near-critical liquid carbon dioxide or supercritical fluid carbon dioxide in the preparation vessel;

(d) introducing means for introducing a solution or a suspension of the textile treatment material in near-critical liquid carbon dioxide or supercritical fluid carbon dioxide into a textile treatment system; and (e) a textile treatment system that is adapted to be maintained at a second set of temperature, pressure and flow conditions controllably independent from the first set of temperature, pressure and flow conditions.

11. The system of claim 10, wherein the mixing means comprises circulating means for circulating a textile treatment material and near-critical liquid carbon dioxide or supercritical fluid carbon dioxide through the preparation vessel.

12. The system of claim 10, wherein the mixing means comprises stirring means for stirring a textile treatment material and near-critical liquid carbon dioxide or supercritical fluid carbon dioxide in the preparation vessel.

13. The system of claim 10, further comprising a filter for filtering a solution of textile treatment material prior to introducing the solution into the textile treatment system.

14. A system or introducing a textile treatment material and for treating textile materials, the system comprising:

(a) a preparation vessel adapted for placement in fluid communication with a supercritical fluid carbon dioxide textile treatment system, the preparation vessel also adapted for receiving a textile treatment material and for containing near-critical liquid carbon dioxide or supercritical fluid carbon dioxide at a first set of temperature, pressure and flow conditions;

(b) isolating means for reversibly isolating the preparation vessel from a supercritical fluid carbon dioxide textile treatment system;

(c) mixing means for mixing a textile treatment material with near-critical liquid carbon dioxide or supercritical fluid carbon dioxide in the preparation vessel;

(d) introducing means for introducing a solution or a suspension of the textile treatment material in near-critical liquid carbon dioxide or supercritical fluid carbon dioxide into a supercritical fluid carbon dioxide textile treatment system; and (e) a supercritical fluid carbon dioxide textile treatment system that is adapted to be maintained at a second set of temperature, pressure and flow conditions controllably independent from the first set of temperature, pressure and flow conditions.

15. The system of claim 14, wherein the mixing means comprises circulating means for circulating a textile treatment material and near-critical liquid carbon dioxide or supercritical fluid carbon dioxide through the preparation vessel.

16. The system of claim 14, wherein the mixing means comprises stirring means for stirring a textile treatment material and near-critical liquid carbon dioxide or supercritical fluid carbon dioxide in the preparation vessel.

17. The system of claim 14, further comprising a filter for filtering a solution of textile treatment material prior to introducing the solution into the supercritical fluid carbon dioxide textile treatment system.

18. The system of claim 14, further comprising diverting means for diverting carbon dioxide from the supercritical fluid carbon dioxide textile treatment system to the preparation vessel.

* * * * *